US006543893B2

(12) United States Patent
Desormeaux

(10) Patent No.: US 6,543,893 B2
(45) Date of Patent: Apr. 8, 2003

(54) SOLID AND SEMI-FLEXIBLE BODY INKJET PRINTING SYSTEM

(75) Inventor: David A. Desormeaux, Ft. Collins, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/952,187

(22) Filed: Sep. 14, 2001

(65) Prior Publication Data

US 2002/0070988 A1 Jun. 13, 2002

Related U.S. Application Data

(63) Continuation of application No. 09/428,681, filed on Oct. 27, 1999, now Pat. No. 6,312,124.

(51) Int. Cl.[7] ..... B41J 2/01
(52) U.S. Cl. ..... 347/109
(58) Field of Search ..... 347/2, 108, 109; 400/88, 691; 358/473; 346/143

(56) References Cited

U.S. PATENT DOCUMENTS

| | | | | |
|---|---|---|---|---|
| 4,940,350 A | | 7/1990 | Kim | 401/209 |
| 5,311,208 A | | 5/1994 | Burger et al. | 345/163 |
| 5,578,813 A | | 11/1996 | Allen et al. | 250/208.1 |
| 5,593,236 A | | 1/1997 | Bobry | 400/88 |
| 5,634,730 A | | 6/1997 | Bobry | 400/88 |
| 5,644,139 A | | 7/1997 | Allen et al. | |
| 5,686,720 A | | 11/1997 | Tullis | 250/208.1 |
| 5,703,353 A | | 12/1997 | Blalock et al. | 250/214 C |
| 5,729,008 A | | 3/1998 | Blalock et al. | 250/208.1 |
| 5,769,384 A | | 6/1998 | Baumgartner et al. | 250/214 A |
| 5,825,044 A | | 10/1998 | Allen et al. | 250/557 |
| 5,927,872 A | | 7/1999 | Yamada | 400/88 |
| 5,980,018 A | | 11/1999 | Taylor et al. | 347/31 |
| 5,988,900 A | | 11/1999 | Bobry | 400/88 |
| 6,312,124 B1 | * | 11/2001 | Desormeaux | 347/2 |

* cited by examiner

*Primary Examiner*—Huan Tran

(57) ABSTRACT

A handheld inkjet printing mechanism is provided for printing a selected image on a print surface of a solid hard body or a semi-flexible body, such as on human skin for face-painting at carnivals, for temporary tattoos, body decorations and the like, on walls and furniture for printing designs, on packages and building materials for labeling purposes, etc. The printing mechanism has a chassis which supports a controller that stores the selected image. An inkjet printhead supported by the chassis selectively ejects inkjet ink onto the print surface in response to the controller as an operator moves the printing mechanism over the print surface to record the selected image thereon. A printhead-to-print surface spacing device controls the spacing between the printhead and the print surface while printing. A printing method using such a handheld printing mechanism is also provided.

25 Claims, 3 Drawing Sheets

1/3
20
28
34
52
55
42
53
50
54
32

42
45
38
34
46
44
36
55
40
32
58
54
26
20
48
28
30
56
25
22
24

36
34
55
54
20
30
26
32

SOLID AND SEMI-FLEXIBLE BODY INKJET PRINTING SYSTEM

CROSS REFERENCE TO RELATED APPLICATION

This is a continuation of application Ser. No. 09/428,681 filed on Oct. 27, 1999 now U.S. Pat. No. 6,312,124.

FIELD OF THE INVENTION

This invention relates generally to printing with an inkjet printing mechanism and more particularly to a new handheld, solid and semi-flexible body inkjet printing system for printing images on hard or semi-flexible surfaces, and in particular, on human skin, such as for face-painting at carnivals, for temporary tattoos, for body decorations, and the like.

BACKGROUND OF THE INVENTION

Typical inkjet printing mechanisms use cartridges, often called "pens," which shoot drops of liquid colorant, referred to generally page. Each cartridge has a printhead formed with very small nozzles through which the ink drops are fired. Most often, the printhead is held in a carriage that slides back and forth along a guide rod in a "reciprocating printhead" system, with the page being advanced in steps between each pass of the printhead. To print an image on paper media, for instance, the printhead is propelled back and forth across the page, shooting drops of ink in a desired pattern as it moves. Other printing systems, known as "page-wide array" printers, extend the printhead across the entire page in a stationary location and print as the media advances under the printhead. The particular ink ejection mechanism within either type of printhead may take on a variety of different forms known to those skilled in the art, such as those using piezo-electric or thermal printhead technology.

For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be maintained to promote printhead health. For storage, or during non-printing periods, the service stations usually include a capping system which hermetically seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved through relative motion of the printhead and wiper, for instance by moving the printhead across the wiper, by moving the wiper across the printhead, or by moving both the printhead and the wiper.

To improve the clarity and contrast of the printed image, recent research has focused on improving the ink itself. To provide quicker, more waterfast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper. Typically, these inks are supplied in a reservoir housed by the inkjet cartridge, so when the reservoir is emptied, the entire cartridge including the printhead is replaced in what is known as a "replaceable cartridge" system. Some cartridges are monochrome (single color), for instance, carrying only black ink, while other cartridges are multi-color, typically carrying cyan, magenta and yellow inks. Some printing mechanisms use four monochrome cartridges, while others use a black monochrome cartridge in combination with a tri-color cartridge.

Recently, an imaging cartridge system has been introduced by the Hewlett-Packard Company of Palo Alto, Calif., as the DeskJet® 693C model inkjet printer. This is a two-pen printer which uses a tri-color cartridge, carrying full dye-loads of cyan, magenta and yellow, and a black cartridge which may be replaced with a tri-color imaging cartridge. This imaging cartridge carries reduced dye-load concentrations of some colors, such as cyan and magenta, along with a full or partial dye-load concentration of black ink. The imaging cartridge allows the printer to produce more continuous tone changes, particularly flesh tones, so the resulting image has near-photographic quality, with very little graininess.

As the inkjet industry investigates new printhead designs, one tendency is toward using a "snapper" reservoir system where permanent or semi-permanent printheads are used and a reservoir carrying a fresh ink supply is snapped into place on the printhead. These snapper reservoirs are typically installed in reciprocating printers, which move both the printhead and the snapper reservoir back and forth across the media for printing. Another new design uses permanent or semi-permanent printheads in what is known in the industry as an "off-axis" printer. In an off-axis system, the printheads carry only a small ink supply reciprocally back and forth across the printzone, with this on-board supply being replenished through tubing that delivers ink from an "off-axis" main reservoir placed at a remote, stationary location within the printer. Rather than purchasing an entire new cartridge which includes a costly new printhead, the consumer buys only a new supply of ink or an "ink bag" for the main reservoir. Typically, the fresh ink supplies are sold individually by color, although in some implementations, a multi-color supply may be furnished.

From the discussion above, it is apparent that the vast majority of inkjet printing has been done on paper, although inkjet printing is often done on transparencies, foils, fabrics and other sheet-like media. It would be desirable to provide a new system which expands the concepts of inkjet printing to other uses, such as for printing images on hard or semi-flexible surfaces, and in particular, on human skin, such as for face-painting at carnivals and the like, in a manner that is both easy and economical to use. The matter of permanence, semi-permanence or temporariness of the printed image may be governed, at least in part, by the selection of the ink used to print the image, as well as the environment to which the printed image is exposed.

SUMMARY OF THE INVENTION

According to one aspect of the invention, a inkjet printing system is provided to print an image using inkjet technology on a print media which may be non-sheet-like, such as upon a hard surface, for instance, lumber which is ready to be shipped on a pallet to a jobsite, or on a semi-flexible surface like human skin when face-painting at carnivals, for temporary tattoos, for body decorations, and the like. The printing system includes a handheld inkjet printing mechanism for printing a selected image on a print surface of a solid body or a semi-flexible body. This handheld printing mechanism has a chassis, and a controller supported by the chassis, with the controller storing the selected image. An inkjet printhead is supported by the chassis to selectively eject inkjet ink onto the print surface in response to the controller. A printhead-to-print surface spacing device controls the spacing between the printhead and the print surface. The spacing device is supported by the chassis to traverses over the print surface when moved along the print surface by an operator while the printhead selectively ejects ink onto the print surface to record the selected image thereon.

According to yet another aspect of the invention, a method is provided of printing a selected image on a print surface of a solid body or a semi-flexible body, including the step of traversing a chassis supporting an inkjet printhead over the print surface. During the traversing step, in a maintaining step, a selected spacing is maintained between the inkjet printhead and the print surface. In an ejecting step, ink is selectively ejected from the printhead to record the selected image on the print surface during the traversing step.

An overall goal of the present invention is to provide an inkjet printing system and method for printing on non-sheet-like material, such as hard or semi-flexible surfaces, such as skin for pace-painting and the like, which is fast, economical, and easy to use, along with providing superior print quality.

A further goal of the present invention is to provide an economical inkjet cartridge or replaceable ink supply for use with such a printing system, which is economical and easy for consumers to install, and which prints on and adheres to skin.

Another goal of the present invention is to provide a portable, handheld, inkjet printing system which may download images from a computer or scanner, or which may accept image cartridges having one or more images stored thereon, and which may have a display screen to preview the image to be printed, as well as a device which may allow for customization of the image in the field, such as the addition of a name or other information.

DETAILED DESCRIPTION OF THE PREFERRED EMBODIMENTS

Figures 1, 2, 3:
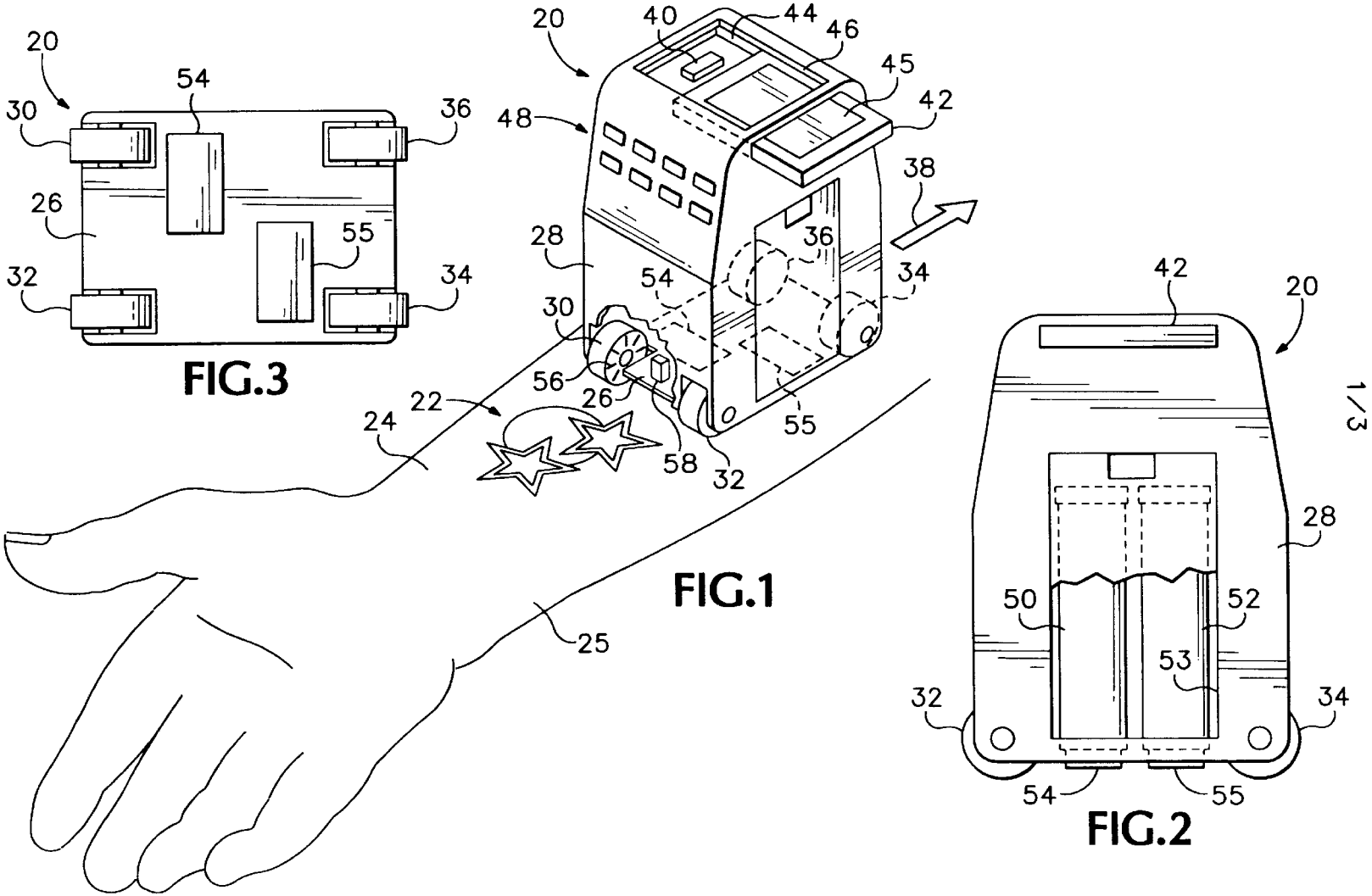
FIG. 1 is a partially schematic, perspective view of one form of a portable, solid body and semi-flexible body inkjet printing mechanism of the present invention, shown here printing an image on a semi-flexible skin surface of an arm.
FIG. 2 is a side elevational view of the inkjet printing mechanism of FIG. 1.
FIG. 3 is a bottom plan view of the inkjet printing mechanism of FIG. 1.

FIGS. 1–3 illustrate one embodiment of a portable, solid body and semi-flexible body inkjet printing mechanism 20, constructed in accordance with the present invention, which may be used for printing of information, photographic images, designs, graphics, and the like, such as the moon and stars design 22 on a solid body or a semi-flexible body, such as the skin 24 covering arm 25, in an industrial, office, home or other environment. This body inkjet printing system may be used in a variety of different portable, hand-held configurations to print images on other surfaces, such as for marking packages in a warehouse, field-marking containers, or pallets of lumber. Many other industrial, business, study and home uses for this portable printer 20 may be envisioned, where a light-weight, portable, easily-read marking system is desired. For convenience the concepts of the present invention are illustrated in the environment of a portable inkjet printer 20 used to form images on the semi-flexible surface of human skin 24. The print media may be any type of hard or semi-flexible material, but for convenience, the illustrated embodiment is described using skin 24.

While it is apparent that the printer components may vary from model to model, the illustrated inkjet printer 20 includes a first chassis portion comprising a frame or base 26 surrounded by a second chassis portion comprising a housing, casing or enclosure 28, typically of a plastic material. A group of four rollers or wheels 30, 32, 34 and 36 are rotationally mounted to the chassis base 26 to move the printer 20 evenly over the print surface, here, skin 24, in the direction of arrow 38. The printer 20 also has a printer controller, illustrated schematically as a microprocessor 40, which in this embodiment receives print instructions from a replaceable, interchangeable image cartridge 42. The image cartridge 42 is illustrated as being slideably received in a slot 44 defined by the chassis housing 28 to be electrically coupled to the controller 40 when fully inserted in the slot 44. The cartridge 42 may include a display surface 45 that carries indicia indicating the image or images which may be printed when the cartridge is installed in printer 20. Preferably, the chassis housing 28 defines a window 46 through which indicia printed on the display surface 45 may be viewed when the cartridge 42 is installed.

It is apparent that use of a replaceable image cartridge 42 has many advantages, depending upon the configuration selected for the controller 40. For example, the main portion of the microprocessor may be housed within the image cartridge 42, allowing consumers to upgrade the printing abilities of their printer when a new cartridge 42 is purchased. As an alternative to such a "smart cartridge" embodiment, the controller 40 may be constructed to house the main portion of the microprocessor, leaving the cartridge 42 to only carry data to the controller to provide a more expensive printer 20, and more economically priced image cartridges 42. Thus, as used herein, the term "printer controller 40" encompasses these functions, whether performed by the on-board portion of the controller 40, by the cartridge 42, an intermediary device therebetween or linked thereto, or by a combined interaction of such elements. The printer controller 40 may also operate in response to user inputs provided through a key pad 48 or other input device located on the exterior of the chassis casing 28.

In the illustrated example, the skin 24 receives ink from a pair of inkjet cartridges 50 and 52, which may be monochrome cartridges, such as a black ink cartridge and/or a color ink cartridge. The cartridges 50 and 52 are also often called "pens" by those in the art. The pens 50, 52 are received within a receptacle 53 formed within the chassis housing 28 and aligned to the chassis base 26 using conventional datums, for instance as described in U.S. Pat. Nos. 4,872,026 and 5,617,128, both assigned to the Hewlett-Packard Company of Palo Alto, Calif. Multi-color images may be printed using tri-color cartridges, with a black image being formed by printing dots of cyan, magenta and yellow all at the same location, forming what is known in the art as a "process black," as opposed to a "true black" which would be formed by printing with a black ink cartridge. The pens 50, 52 may contain pigment based inks, dye based inks, or other types of inks, such as thermoplastic, wax or paraffin based inks, as well as hybrid or composite inks having both dye and pigment characteristics.

The illustrated pens 50, 52 each include reservoirs for storing a supply of ink. The pens 50, 52 have printheads 54, 55 respectively, each of which have an orifice plate with a plurality of nozzles (not shown) formed therethrough in a manner well known to those skilled in the art. The illustrated printheads 54, 55 are thermal inkjet printheads, although other types of printheads may be used, such as piezoelectric printheads. The printheads 54, 55 typically include a substrate layer having a plurality of resistors which are associated with the nozzles. Upon energizing a selected resistor, a bubble of gas is formed to eject a droplet of ink from the nozzle and onto the print surface, such as skin 24. The printhead resistors are selectively energized in response to enabling or firing command control signals, which may be delivered by a conventional multi-conductor strip (not shown) from the controller 40 to the printheads, and through conventional electro-mechanical interconnects between the cartridge receptacle 53 defined by the chassis housing 28 and the pens 50, 52, then to the printheads 54, 55.

Preferably, the outer surface of the orifice plates of the printheads 54, 55 lie in a common printhead plane. This printhead plane may be used as a reference plane for establishing a desired media-to-printhead spacing, which is one important component of print quality. In the illustrated embodiment, the media-to-printhead spacing is determined by the extent to which the wheels 30–36 project beyond the lower surface of the printheads 54, 55, as can best be seen in the view of FIG. 2. Of course there may be some flexibility to the surface of the skin 24, into which the wheels may protrude, requiring a larger media-to-printhead spacing distance than would be required when printing on a solid surface, such as on lumber or on drywall (also known in the building trades as "sheet rock"). This variance in the print surface characteristics may be accommodated by making the wheels 30–36 of a larger diameter for semi-flexible print surfaces like skin, such as by using interchangeable wheels, or by allowing an operator to adjust the wheel height relative to the bottom surface of the housing using a conventional lever or screw mechanism (not shown).

As shown in FIG. 1, to track the linear position of the printer 20 as it moves across the skin 24 in the direction of arrow 38, the printer 20 may include a positional feedback mechanism, such as a conventional rotary encoder 56 which may be mounted to the circular side surface of one of the wheels, for instance on wheel 30. An optical encoder reader 58 may be mounted to the chassis base 26 to read the indicia on the rotary encoder 56 and provide a positional signal to controller 40. Such a rotary encoder system 56, 58 is known in the art for monitoring media position, such as when a sheet of media advances through the printzone, for instance as described in U.S. Pat. No. 5,774,074. As an operator rolls printer 20 across the skin 24, the controller 40 coordinates the firing signals sent to the inkjet nozzles of printheads 54, 55 with the positional feedback signal received from the encoder reader 58 to direct the ink droplets to print the image 22 according to the instructions on the image cartridge 42, or according to information stored in the controller 40.

Figure 4:
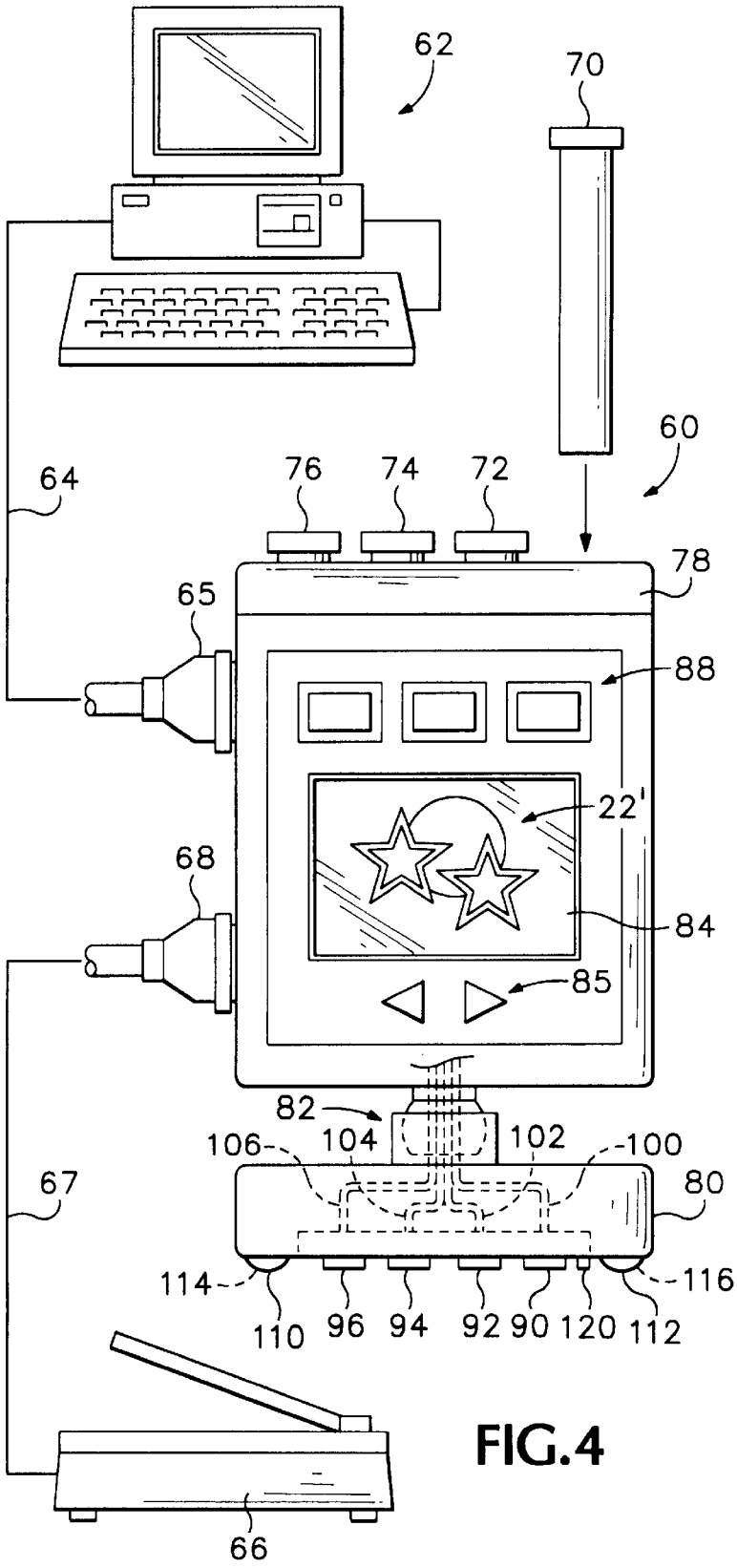
FIG. 4 is a partially schematic, perspective view of an alternate form of a portable, solid body and semi-flexible body inkjet printing mechanism of the present invention, shown here coupled to two different image input devices, one being a scanner for loading custom images, and the other being a computer, along with a replaceable inkjet ink supply ready to be installed in the printing mechanism.
Figure 5:
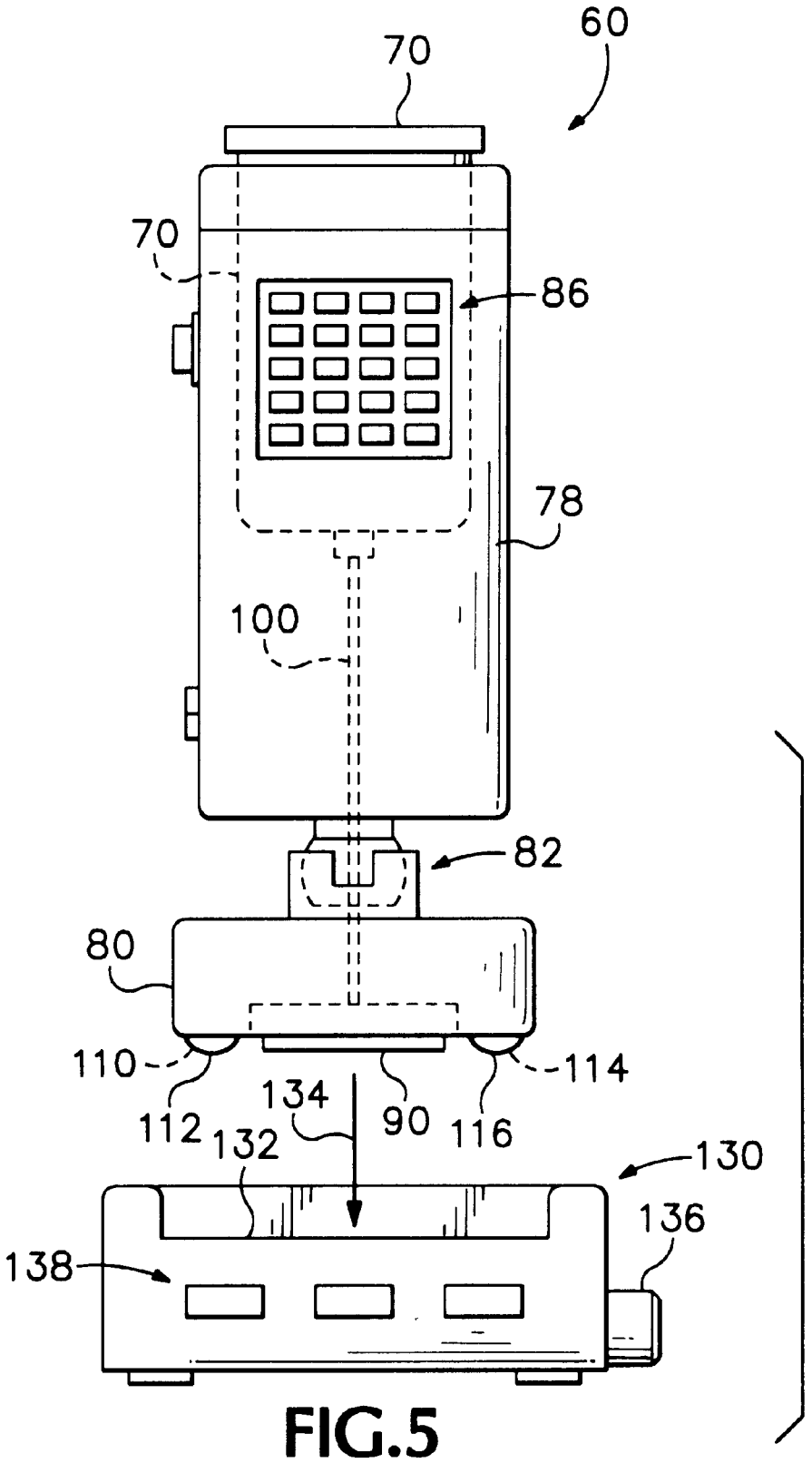
FIG. 5 is an enlarged side elevational view of the inkjet printing mechanism of FIG. 4, shown ready for installation into storage and printhead servicing mechanism used to maintain printhead health.

FIGS. 4 and 5 illustrate another embodiment of a portable, solid body and semi-flexible body inkjet printing mechanism 60, constructed in accordance with the present invention, which may be used for printing of information, photographic images, designs, graphics, and the like, such as the moon and stars design 22', on a solid body or a semi-flexible body, such as the skin 24 covering arm 25, in an industrial, office, home or other environment. The functions and features of printer 60 are similar to those described above for printer 20, and both embodiments may be likewise adapted to have similar features. Here we see printer 60 coupled to a host computer 62 from which images, such as design 22' may be downloaded through a signal 64, which may be hard-wired to the printer at terminal 65, or may be otherwise downloaded, such as through an infrared or other signal. The design 22' may also be provided to the printer 60 from a scanner 66 through a signal 67, which may be hard-wired to the printer at terminal 68, or may be otherwise downloaded, such as through an infrared or other signal. Alternatively, the image 22' may be provided through an image cartridge, as described above for printer 20. Images to be printed may be downloaded from other sources, such as from the Internet or world-wide web.

The printer 60 holds four replaceable ink reservoirs 70, 72, 74 and 76 which contain black, cyan, magenta and yellow inks, respectively, within receptacles defined by a first chassis portion comprising a main housing or enclosure portion 78 of the printer. The printer 60 has a second chassis portion comprising a printhead housing 80 which is flexibly mounted to the main enclosure 78 at a flexible, gimbal-mounted, neck portion 82. The chassis main enclosure 78 may be equipped with a display portion 84, such as an LCD (liquid crystal display) screen that displays usage instructions, or a representation of an image 22' to be printed. Image selection input keys 85 may be used to scroll through a variety of images stored in a controller portion of the printer, which may operate as described above for the controller 40. Images may be customized through inputs provided by a keyboard, such as an alpha-numeric keyboard 86. Other input keys 88 may also be provided on the exterior of the chassis housing 78, such as to begin a print job, or this location may be used to provide an operator with information, such as whether to speed-up or slow down when moving across a print surface, such as skin 24 (FIG. 1).

The chassis printhead housing 80 holds four inkjet printheads 90, 92, 94 and 96 which are coupled to the reservoirs 70, 72, 74 and 76, respectively, through a series of ink delivery tubes 100, 102, 104 and 106, respectively, which extend through the neck portion 82. While the printheads 90–96 are illustrated as being four separate items, as advances in inkjet technology and silicon manufacturing techniques are made, it may be very feasible now, or in the near future to form four large printheads, for instance having nozzles arrays of an inch (2.54 centimeters) or longer, on a single piece of silicon. The ink delivery tubes 100–106 may be constructed from a variety of different ink-compatible flexible tubing materials, such as the plastic tubing used in the Hewlett-Packard Company's DeskJet® 2000C Professional Series inkjet printer. Indeed, the printheads 90–96, as well as the ink reservoirs 70–76, may be constructed using the technology employed in the DeskJet® 2000C Professional Series inkjet printer.

To maintain a proper printhead-to-print surface spacing, the printhead housing 82 may include a group of wheels as described above for wheels 30–36, or a group of fixed spacer protrusions or skids 110, 112, 114 and 116. The skid bumps 110–114 slide over the print surface, such as skin 24. The chassis printhead housing 80 may also carry an optical sensor 120 which may be used to provide a positional feedback signal to the printer controller, as described above with respect to the encoder 58 of printer 20, or if equipped with wheels 30–36 rather than with the skids 110–116, a rotary encoder may be used, as described above for encoder 56. Such an optical sensor 120 may be used to view surface irregularities in the print surface such as hairs on the skin, and from this information, determine the speed of the printing stroke 38. Alternatively, a strip of tape carrying regularly-spaced markings or other indicia may be placed on the print surface to lie under sensor 120 during the print stroke, with the tape acting then as a linear encoder and the sensor 120 acting as an optical pattern sensor to generate a positional feedback signal.

As described above in the Background section, inkjet printheads require servicing to maintain pen health. In conventional inkjet printers used to print on sheet media, a service station is typically mounted within the printer housing. For a portable, handheld printer 20 or 60, to keep the printer unit light weight for ease of use, a separate service station unit 130 is useful. The service station 130 may be constructed in a variety of different ways known to those skilled in the art, for instance, using the principles described in the allowed U.S. patent application Ser. No. 08/667,610, filed on Jul. 3, 1996, and assigned to the Hewlett-Packard Company. The illustrated service station 130 has a receptacle 132 which is sized to receive and grip the chassis printhead housing 80, as indicated by arrow 134. The service station 130 has a motor 136 which moves the various servicing components, such as wipers and caps into place to service the printheads 90–96, for instance, in response to inputs received from an operator through a keypad 138. For instance, a spitting and wiping routine may be required following a print job, followed thereafter by a capping sequence for periods of storage. One of the inputs to keypad 138 may be used to initiate a spitting and wiping routine following a period of storage to ready the printer 20, 60 for printing.

CONCLUSION

A variety of advantages are realized using the handheld inkjet printer 20, 60, beyond the ability to use inkjet technology to print on non-traditional solid body and semi-flexible body print surfaces, as well as on conventional sheet media, such as paper. Preferably, the printers 20, 60 are lightweight and portable, for instance about the same size as a man's electric shaver or a cellular telephone. One advantage of the gimbal-mounted neck 82 of printer 60 is the ability to keep the chassis printhead housing 80 flush with the print surface, allowing for some natural ergonomic tilting of the operator's hand holding the chassis main body 78 while printing, without inducing drop trajectory print defects in the image 22.

The ability to couple the printer 60 to a computer 62 allows the latest in imaging and photo software to be used to generate images, including customized images, as well as images entered through scanner 66, for instance the photo of a boyfriend, girlfriend, or one's favorite pet or hobby. Indeed, the computer 62 may be used to download images from a website on the Internet. The alpha-numeric keypad 48, 86 on the printer 20, 60 may allow for further customization of images when printing at a location which is remote from a computer, such as when face-painting at a carnival where a child might wish to have their name printed on their skin instead of, or in addition to a design. The alpha-numeric keypad 48, 86 may also be useful in other contexts, such as when marking containers during an inventory at a warehouse. Such inventory information could also be stored in the controller 40 of printer 20 or 60, and later downloaded onto the computer 62. Indeed, the handheld printers 20, 60 may be used to print on other surfaces, such as for applying tole or other designs to furniture or walls, or for addressing packages to eliminate adhesive mailing labels.

While the initial thought was to apply a washable ink to the skin for temporary images, in some printing situations, a more permanent ink may be desirable, such as for marking containers in a warehouse. A semi-permanent ink may be desirable for applying an image to the skin instead of a getting a permanent tattoo, with the inkjet image eventually fading away, which may also be useful as a precursor to getting a permanent tattoo to first decide whether one really likes the image selected. Depending upon the type of ink(s) used and the nature of the particular print surface, some preparation of the print surface prior to printing may be desirable, such as wiping skin 24 with an alcohol-soaked pad before printing to assure a clean surface for good ink adhesion.

While the illustrated embodiments of printers 20 and 60 both include positional feedback to the controller 40, using the optical rotary encoder 56 and reader 58 in FIG. 1, and the optical sensor 120 in FIG. 4, positional feedback is not a requirement if an operator has a steady hand with a smooth print stroke, such as in the direction of arrow 38 in FIG. 2. With a positional feedback system, the display screen 84 may be used to display usage instructions to indicate whether and operator should speed-up or slow down a printing stroke for optimal image quality. It is apparent that a variety of other modifications may be made in implementing the concepts of this invention, as illustrated by the embodiments of printers 20 and 60, in particular when tailoring these handheld portable printers for particular uses, and the examples discussed above are merely to illustrate a few of the different ways in which such modifications may be made.

I claim:

1. A handheld inkjet printing mechanism for printing a selected image on a print surface of a solid body or a semi-flexible body, comprising:

a chassis;

a controller supported by the chassis, with the controller storing the selected image therein;

an inkjet printhead supported by the chassis to selectively eject ink onto the print surface in response to the controller;

a printhead-to-print surface spacing device to control the spacing between the printhead and the print surface, with the spacing device being supported by the chassis to traverse over the print surface when moved therealong by an operator while the printhead selectively ejects ink onto the print surface to record the selected image thereon, and wherein the spacing device comprises protrusions projecting from the chassis to slide along the print surface during said movement by the operator; and wherein the controller is configured to be coupled to a replaceable image cartridge from which the controller receives the selected image.

2. A handheld inkjet printing mechanism according to claim 1 wherein the chassis defines an image cartridge receptacle slot into which the replaceable image cartridge may be inserted to deliver the selected image to the controller.

3. A handheld inkjet printing mechanism according to claim 2 for receiving a replaceable image cartridge having a display surface for showing a representation of the selected image, wherein the chassis defines a window therethrough located to view the representation of the selected image on the image cartridge when inserted into the receptacle slot.

4. A handheld inkjet printing mechanism for printing a selected image on a print surface of a solid body or a semi-flexible body, comprising:

a chassis;

a controller supported by the chassis, with the controller storing the selected image therein;

an inkjet printhead supported by the chassis to selectively eject ink onto the print surface in response to the controller;

a printhead-to-print surface spacing device to control the spacing between the printhead and the print surface, with the spacing device being supported by the chassis to traverse over the print surface when moved therealong by an operator while the printhead selectively ejects ink onto the print surface to record the selected image thereon, and wherein the spacing device comprises protrusions projecting from the chassis to slide along the print surface during said movement by the operator; and a display device supported by the chassis and coupled to the controller.

5. A handheld inkjet printing mechanism according to claim 4, further including a positional monitoring device supported by the chassis to generate a positional signal for the controller to indicate the position of the printhead relative to the print surface when moved therealong by the operator.

6. A handheld inkjet printing mechanism according to claim 4 wherein the positional monitoring device comprises an optical sensor.

7. A handheld inkjet printing mechanism according to claim 4 further including a coupling device to couple the controller to a computer to receive the selected image.

8. A handheld inkjet printing mechanism according to claim 4 further including a coupling device to couple the controller to a scanner to receive the selected image.

9. A handheld inkjet printing mechanism according to claim 4 further including an input device coupled to the controller to modify the selected image.

10. A handheld inkjet printing mechanism according to claim 9 wherein the input device comprises a keyboard supported by the chassis.

11. A handheld inkjet printing mechanism according to claim 4 wherein the display device is coupled to the controller to show a representation of the selected image.

12. A handheld inkjet printing mechanism according to claim 4 wherein the display device is coupled to the controller to display usage instructions.

13. A handheld inkjet printing mechanism according to claim 4 wherein the display device comprises a display screen.

14. A handheld inkjet printing mechanism according to claim 4 for use with a printhead servicing unit having a printhead receptacle, wherein a portion of the chassis which supports the printhead is sized to be received by the servicing unit printhead receptacle.

15. A method of printing a selected image on a print surface of a solid body or a semi-flexible body, comprising the steps of:

traversing a chassis supporting an inkjet printhead over the print surface by sliding the chassis across the print surface on protrusions projecting from the chassis;

during the traversing step, maintaining a selected spacing between the inkjet printhead and the print surface;

selectively ejecting ink from the printhead to record the selected image on the print surface during the traversing step; and customizing the selected image using an input device supported by the chassis.

16. A method according to claim 15 further including the step of monitoring the position of the printhead along the print surface during the traversing step.

17. A method according to claim 16 further including the steps of:

generating a positional signal to indicate the position of the printhead in response to the monitoring step; and controlling the ejecting step in response to the generating step.

18. A method according to claim 15 wherein the monitoring step comprises the step of optically sensing the position of the printhead along the print surface during the traversing step.

19. A method according to claim 15 further including the step of receiving the selected image from a computer.

20. A method according to claim 15 further including the step of down-loading the selected image from a website.

21. A method according to claim 15 further including the step of receiving the selected image from a scanner.

22. A method according to claim 15 wherein the customizing step comprises entering information using an input device comprising a keyboard supported by the chassis.

23. A method according to claim 15 further including the step of displaying the selected image using a display device supported by the chassis.

24. A method according to claim 15 further including the step of displaying the usage instructions on a display screen supported by the chassis.

25. A method according to claim 15 further including the step of, following the ejecting step to record the selected image on the print surface, servicing the printhead by placing at least a portion of the chassis in a printhead servicing unit.

* * * * *

UNITED STATES PATENT AND TRADEMARK OFFICE

CERTIFICATE OF CORRECTION

PATENT NO. : 6,543,893 B2
DATED : April 8, 2003
INVENTOR(S) : Desormeaux

It is certified that error appears in the above-identified patent and that said Letters Patent is hereby corrected as shown below:

Column 1,
Line 23, after “generally”, insert -- herein as “ink,” onto a --.

Signed and Sealed this

Third Day of May, 2005

JON W. DUDAS
*Director of the United States Patent and Trademark Office*